US009098014B2

(12) United States Patent
Koyanagi et al.

(10) Patent No.: US 9,098,014 B2
(45) Date of Patent: Aug. 4, 2015

(54) DEVELOPING DEVICE AND IMAGE FORMING APPARATUS

(71) Applicant: CANON KABUSHIKI KAISHA, Tokyo (JP)

(72) Inventors: Masato Koyanagi, Ibaraki (JP); Gosuke Goto, Kawasaki (JP); Kazutoshi Ishida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/460,248

(22) Filed: Aug. 14, 2014

(65) Prior Publication Data

US 2015/0055990 A1 Feb. 26, 2015

(30) Foreign Application Priority Data

Aug. 23, 2013 (JP) ..... 2013-173701

(51) Int. Cl.
*G03G 15/08* (2006.01)

(52) U.S. Cl.
CPC ..... *G03G 15/0822* (2013.01); *G03G 15/0808* (2013.01); *G03G 15/0812* (2013.01)

(58) Field of Classification Search
CPC ..... G03G 15/0808; G03G 15/0806; G03G 15/0812; G03G 15/0818
See application file for complete search history.

(56) References Cited

U.S. PATENT DOCUMENTS 3,754,963 A * 8/1973 Chang ..... 430/101
4,788,570 A * 11/1988 Ogata et al. ..... 399/283
5,315,061 A * 5/1994 Suzuki et al. ..... 399/239
5,379,097 A * 1/1995 Aoto et al. ..... 399/222
5,879,849 A * 3/1999 Sawada et al. ..... 430/108.7
2003/0095814 A1* 5/2003 Miyakawa et al. ..... 399/252
2013/0223891 A1* 8/2013 Koyanagi et al. ..... 399/279

FOREIGN PATENT DOCUMENTS

JP 3162219 B2 4/2001
JP 3272056 B2 4/2002
WO 2013/128551 A1 9/2013

* cited by examiner

*Primary Examiner* — Clayton E Laballe
*Assistant Examiner* — Leon W Rhodes, Jr.
(74) *Attorney, Agent, or Firm* — Canon U.S.A., Inc. IP Division

(57) ABSTRACT

A developing device includes a developing agent bearing member and a regulating member. The developing agent bearing member bears on a surface thereof a developing agent including colored particles and additive particles disposed on the surface of the colored particles. The surface of the developing agent bearing member includes first and second dielectric portions. The regulating member regulates the thickness of a layer of developing agent borne by the developing agent bearing member. In triboelectric series, the first dielectric portion is between the regulating member and the additive particles, the additive particles are between the first dielectric portion and the second dielectric portion, and the second dielectric portion is between the additive particles and the colored particles. The difference between the work functions of the colored particles and second dielectric portion is smaller than that between the second dielectric portion and additive particles.

8 Claims, 11 Drawing Sheets

DEVELOPING DEVICE AND IMAGE FORMING APPARATUS

BACKGROUND OF THE INVENTION

1. Field of the Invention

The present invention relates to a developing device and an image forming apparatus including the developing device.

2. Description of the Related Art

There are known developing devices provided in image forming apparatuses such as laser printers or the like, which have a toner supplying roller (developing agent feed member) which supplies toner (developing agent) to a developing roller (developing agent bearing member), and scrapes off toner borne by the developing roller. The toner supplying roller is used primarily to prevent defective reproduction in solid images and ghosting. Defective reproduction in solid images is a phenomenon where density at the trailing edge of an image drops when the entire image is a 100% solid image. Ghosting is a phenomenon where, when a solid image with high density is formed and then a halftone image or solid white image is formed, traces of the solid image appear on the halftone image or solid white image.

There has been proposed in recent years a developing device from which the aforementioned toner supplying roller is omitted, to realize reduced size and costs of the developing device. Omitting the aforementioned toner supplying necessitates other measures to suppress defective reproduction in solid images and ghosting.

Japanese Patent Nos. 3272056 and 3162219 disclose a configuration of a developing device from which the toner supplying roller has been omitted, where dielectric portions and conductive portions coexist on the surface of the developing roller (developing agent bearing member), in regular or irregular distributions. In this configuration, a developing blade (regulating member) charges the dielectric portions by rubbing, either directly or with toner interposed therebetween, thus forming microfields at the adjoining portions of the dielectric portions and conductive portions. Toner is suctioned to the surface of the developing roller by the gradient force due to the microfields, and thus is borne thereby.

The developing device according to Japanese Patent No. 3272056 is configured such that (−) toner<developing blade<dielectric portion (+) in triboelectric series, in a case where the charging polarity of the toner is negative polarity, for example. In such a configuration, the toner borne by the dielectric portion is powerfully electrostatically adhered to the dielectric portion, so regulation by the developing blade is difficult. Accordingly, the amount or toner coated on the developing roller when forming solid white images may be greater as compared to when forming solid images, and this difference in amount of toner coated may be manifested in the image as a ghost.

While the developing blade does serve to adjust the amount of toner coated, it does not serve to scrape off toner from the developing roller such as a toner supplying roller does. Accordingly, continuously outputting low-coverage images may result in melt-adhesion of toner to the developing roller, resulting in image defects. The lifetime of the developing device thus has to be set shorter, to avoid such image defects.

SUMMARY OF THE INVENTION

It has been found desirable to suppress occurrence of image defects while realizing reduced device size and costs.

To achieve the above-described desire, according to an exemplary configuration described in the present disclosure, a developing device includes a developing agent bearing member configured to bear on a surface thereof a developing agent including colored particles and additive particles disposed on the surface of the colored particles, the surface of the developing agent bearing member including a first dielectric portion, and a second dielectric portion; and a regulating member configured to regulate the thickness of a layer of developing agent borne by the developing agent bearing member. In triboelectric series, the first dielectric portion is between the regulating member and the additive particles, the additive particles are between the first dielectric portion and the second dielectric portion, and the second dielectric portion is between the additive particles and the colored particles. The difference between the work function of the colored particles and the work function of the second dielectric portion is smaller than the difference between the work function of the second dielectric portion and the work function of the additive particles.

Further features of the present invention will become apparent from the following description of exemplary embodiments with reference to the attached drawings.

DESCRIPTION OF THE EMBODIMENTS

Forms by which the present invention may be carried out will be described by way of embodiments, with reference to the attached drawings. It should be noted, however, that dimensions, materials, shapes, relative placement, and so forth of components described in the embodiments should be changed as appropriate depending on the configuration of the apparatus to which the invention is applied, and depending on various conditions. That is to say, the following embodiments are not to be interpreted as restricting the scope of the invention.

Figure 11:
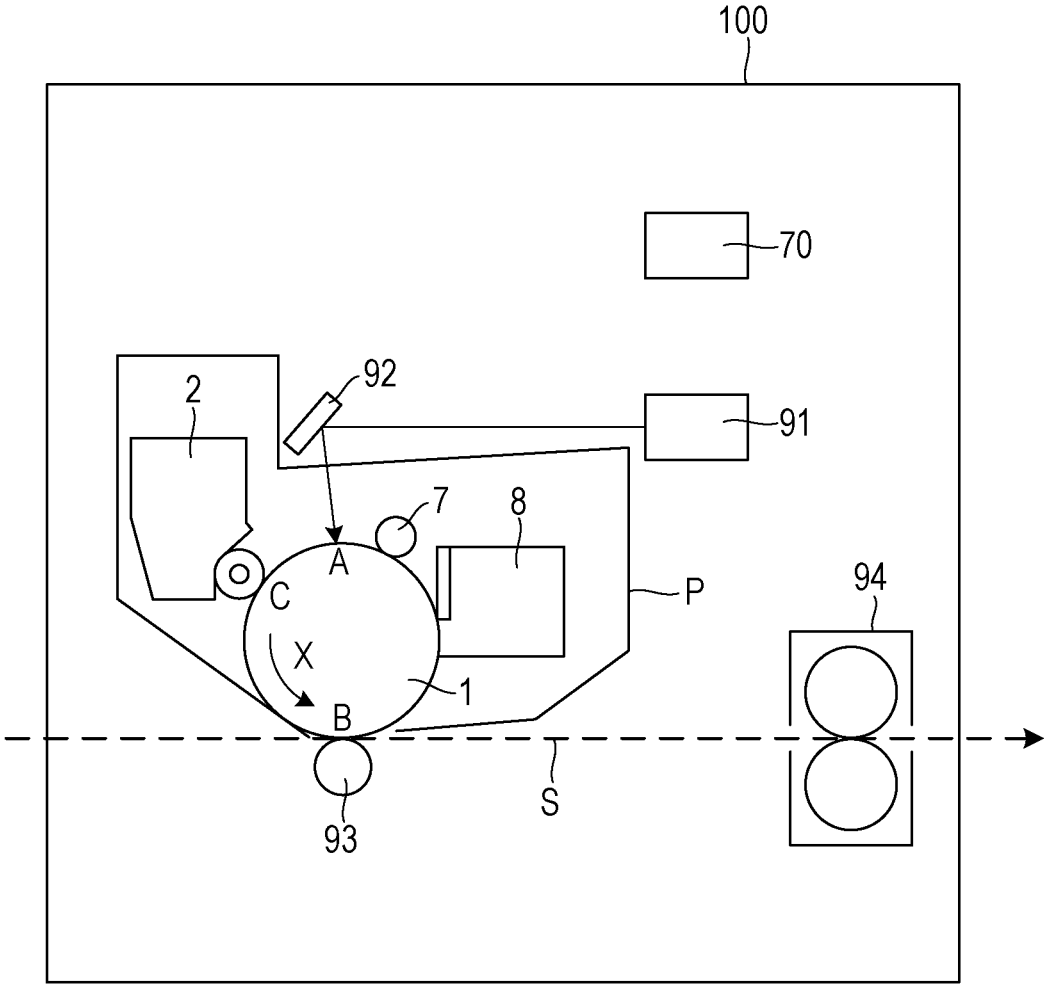
FIG. 11 is a schematic cross-sectional view illustrating an image forming apparatus according to an embodiment.

First, an image forming apparatus according to an embodiment will be described with reference to FIG. 11. FIG. 11 is a schematic cross-sectional view illustrating an image forming apparatus according to the embodiment. An image forming apparatus 100 according to the embodiment includes, as primary components, a photosensitive drum 1, a developing device 2, a cleaning device 8, a charging roller 7, an exposure device 91, a transfer roller 93, a fixing unit 94, and so forth.

The photosensitive drum 1, developing device 2, cleaning device 8, and charging roller 7 are integrated as a process cartridge P, which is detachable from the main body of the image forming apparatus (the portion of the image forming apparatus 100 excluding the process cartridge P). The developing device 2 contains therein toner serving as a developing agent having negative normal charging polarity (charging polarity for developing an electrostatic latent image; the normal charging polarity of the toner in the embodiment is negative, since reversal developing of an electrostatic latent image having negative polarity is performed).

The exposure device 91 and a reflecting mirror 92 are situated such that a laser beam emitted from the exposure device 91 reaches an exposure position A on the photosensitive drum 1 via the reflecting mirror 92. The transfer roller 93 is positioned beneath the photosensitive drum 1. A transfer material S such as paper or the like, onto which transfer has been performed, is fed to the fixing unit 94. The cleaning device 8 is disposed downstream from the transfer position in the movement direction of the photosensitive drum 1. A blade which is provided thereto is disposed in contact with the photosensitive drum 1 so as to scrape off toner.

Image forming operations of the image forming apparatus 100 will be described. A controller unit 70 centrally controls the image forming apparatus which will be described below, following a predetermined control program and reference table. First, the surface of the photosensitive drum 1, which is 24 mm in outer diameter, and rotates in the direction indicated by the arrow X at 150 mm/sec, is charged by the charging roller 7 to a predetermined potential. An electrostatic latent image is formed at the exposure position A on the photosensitive drum 1 by a laser beam emitted from the exposure device 91 in accordance with image signals. The formed electrostatic latent image is developed by the developing device 2 at a developing position C, thus forming a toner image which is a developed image. Thus, the photosensitive drum 1 is an image bearing member which bears upon the surface thereof an image (electrostatic latent image and developed image. The toner image formed on the photosensitive drum 1 is transferred onto the transfer material S at a transfer position B. The transfer material S upon which the toner image has been transferred is conveyed to the fixing unit 94, where the toner image is fixed onto the transfer material S by application of pressure and heat, thereby yielding a final image.

First Embodiment

Figure 1:
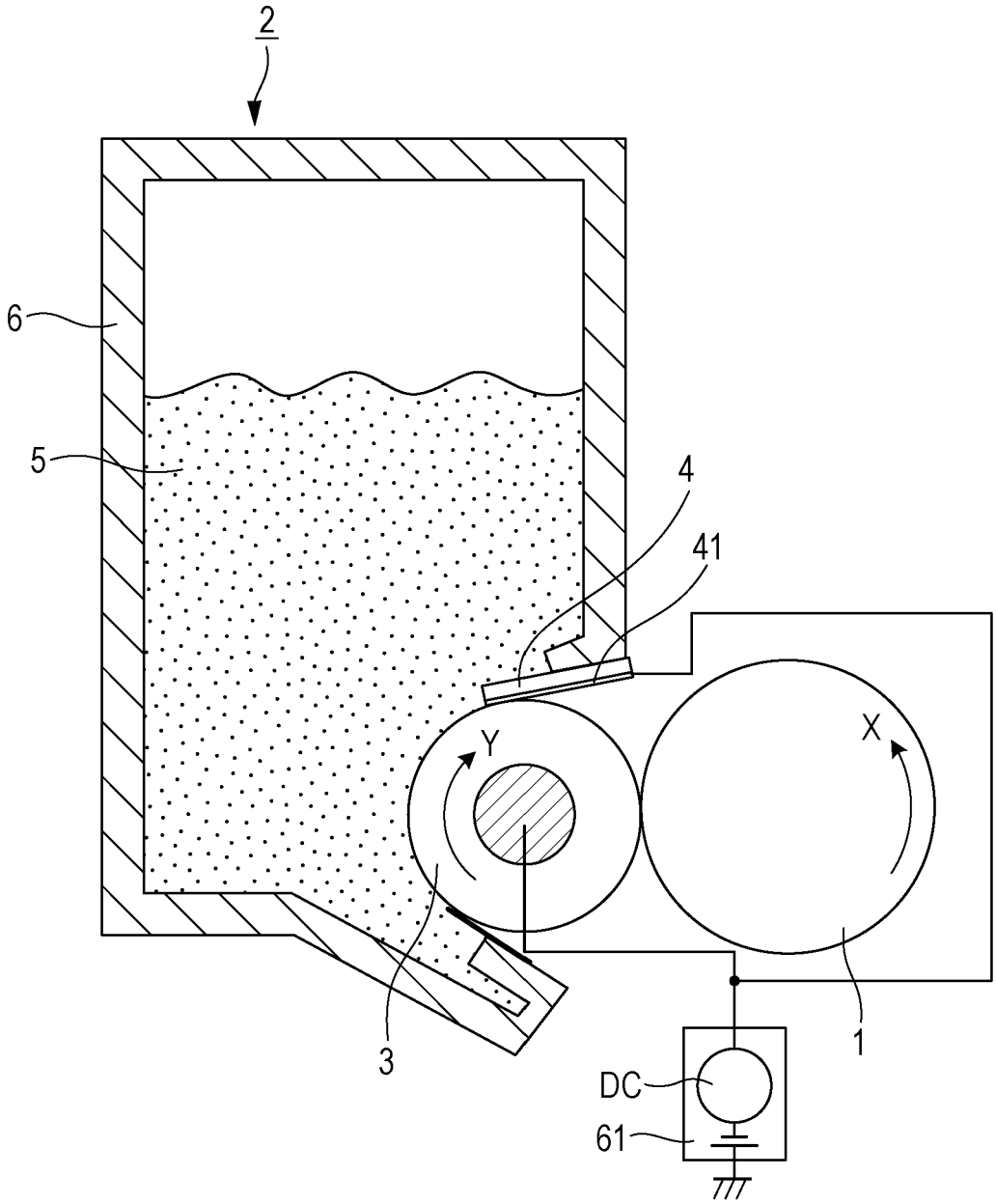
FIG. 1 is a schematic cross-sectional view of a developing device according to a first embodiment.

First, the developing device 2 according to a first embodiment will be described with reference to FIG. 1. FIG. 1 is a schematic cross-sectional view illustrating the developing device 2 according to the first embodiment. The developing device 2 according to the first embodiment is used as a developing unit of an electrophotographic image forming apparatus such as a laser printer or the like. The developing device 2 includes a developing roller 3 serving as a developing agent bearing member, a developing blade 4 serving as a regulating member, and a developer container 6.

Hereinafter, the contact portion between the developing roller 3 and the photosensitive drum 1 serving as an image bearing member will be referred to as a "developing portion", and the contact portion between the developing roller 3 and the developing blade 4 will be referred to as "regulating portion". The developing roller 3 is provided in contact with the photosensitive drum 1 in the first embodiment.

The developer container 6 accommodates toner 5, which is a non-magnetic single-component developing agent. The developing roller 3 is rotationally driven in the direction of the arrow Y at a peripheral speed of 180 mm/sec. The developing blade 4 regulates the thickness of the toner layer borne by the developing roller 3. The developing blade 4 also has a charging layer 41, which functions as a charge imparting part to impart a predetermined charge to the toner 5 at the dielectric portion on the developing roller 3, and as a developing agent charging part to impart a predetermined charge to the toner 5.

The developing device 2 according to the first embodiment does not have a toner supplying roller serving as a developing agent feed member to supply toner to the developing roller 3 and also scrape off toner borne on the developing roller 3.

Figure 2A:
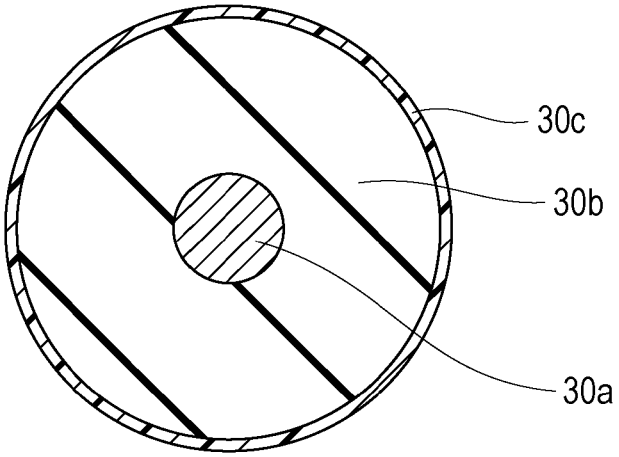
FIGS. 2A through 2C are schematic drawings for describing a developing roller according to the first embodiment.
Figure 2B:
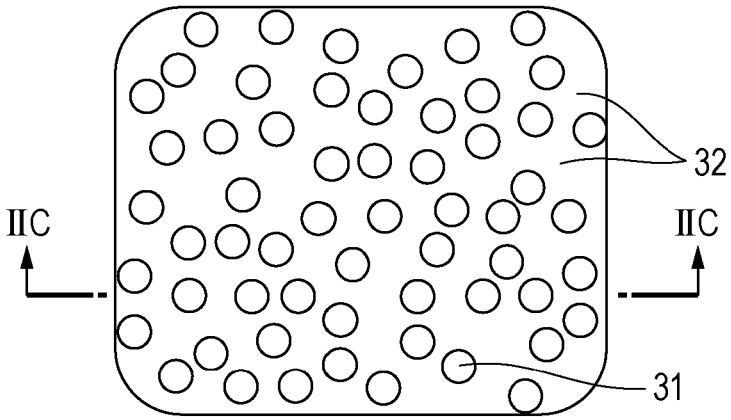
Figure 2C:
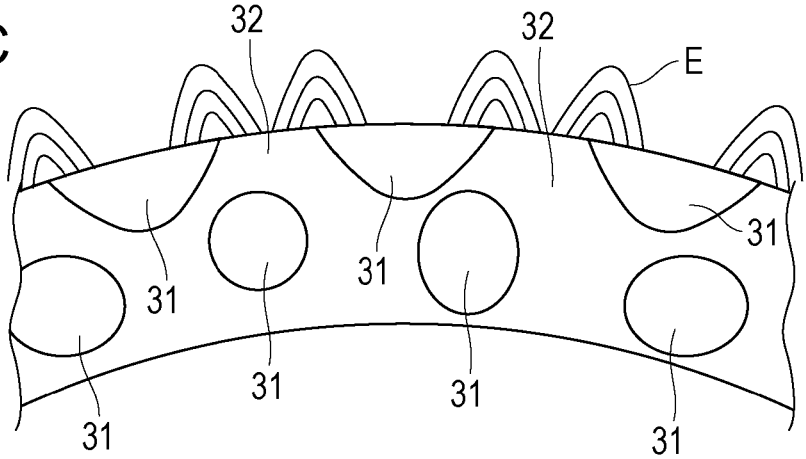

The developing roller 3 has on the surface thereof first dielectric portions 31 and a second dielectric portion 32, each having different work functions (see FIGS. 2B and 2C). The charging layer 41 of the developing blade 4 rubs the first dielectric portions 31 and second dielectric portion 32, either directly or with toner interposed therebetween. The dielectric portions are thereby each charged to different potentials, thus forming microfields at the adjoining portions of the dielectric portions. Toner conveyed on the surface of the developing roller 3 is suctioned to the surface of the developing roller 3 by the gradient force due to the microfields, and thus is borne thereby. Accordingly, the developing roller 3 according to the first embodiment bears multiple layers of toner on the surface thereof.

The developing roller 3 according to the first embodiment will be described in detail with reference to FIGS. 2A through 2C. FIGS. 2A through 2C are schematic diagrams for describing the developing roller 3 according to the first embodiment. FIG. 2A is a schematic cross-sectional view of the developing roller 3 according to the first embodiment, FIG. 2B is a plan view of the developing roller 3 according to the first embodiment, and FIG. 2C is a cross-sectional view taken along IIC-IIC in FIG. 2B.

In the first embodiment, the developing roller 3 is configured so that two types of dielectric portions which can carry charges on the surfaces thereof (the first dielectric portions 31 and second dielectric portion 32) coexist exposed in a scattered manner in increments of minute areas. Specifically, the developing roller 3 has an elastic layer 30*b* formed of a conductive rubber material on a mandrel 30*a*, and a surface layer 30*c* made up of a resin material in which dielectric particles have been dispersed, formed on the elastic layer 30*b* by coating or the like. The developing roller 3 is fabricated by polishing the surface layer 30*c*. Charging the first dielectric portions 31 and second dielectric portion 32 by a predetermined method forms microfields indicated by electrical force lines E in FIG. 2C.

The size of the first dielectric portions 31 is adjusted to be around 5 to 500 μm in outer diameter, for example. This is an optimal value range for bearing a charge on the surface and suppressing unevenness in the image. If the outer diameter is smaller than 5 μm, the potential amount which the first dielectric portions 31 and second dielectric portion 32 hold on the surfaces thereof is small, and sufficient microfields cannot be formed. On the other hand, if the outer diameter is greater than 500 μm, the potential difference between the first dielectric portions 31 and second dielectric portion 32 becomes great, and unevenness in the image increases.

Further, after the toner layer thickness regulation work by the developing blade 4 is finished, the first dielectric portion 31 and second dielectric portion 32 have potential after a developing cycle T of the developing roller 3 elapses, and thus hold microfields. Accordingly, electric resistance value R and electrostatic capacitance C of the first dielectric portion 31 and second dielectric portion 32 preferably satisfy CR≥T/Ln 10 (where Ln is a natural logarithm) as to the developing cycle T of the developing roller 3. Accordingly, the first dielectric portions 31 can maintain a charge amount of at least 10% or more after T elapses. The above relationship is satisfied by CR≥0.091, thereby forming microfields.

The volume resistivity of the dielectric particles used was measured by applying voltage of 1000 V for 30 seconds to a measurement specimen under an environment of 23° C. and 50% relative humidity, using a resistance measuring apparatus Hiresta UP, manufactured by Mitsubishi Chemical Corporation. The used amount of the measurement specimen is preferably adjusted taking into consideration the density of particles to be measure, and so forth. 0.6 grams was used in a case of measuring polyethylene resin particles, which was pressurized at 2000 kgf/cm$^2$ to obtain the measurement specimen.

The relative permittivity of the dielectric particles was measured as follows. First, the power specimen was placed in a cylinder having a base area of 2.26 cm$^2$, and 15 kg of pressure was applied to upper and lower electrodes. At the same time, AC voltage of 1 Vpp at frequency of 1 MHz was applied, the current at this time was measured, and later normalized to calculate the relative permittivity. Measurement of the CR at the surface of the first dielectric portions 31 of the developing roller 3 can be substituted by charging the first dielectric portions 31 by a predetermined method and measuring the attenuation rate thereof. For example, a cutout measurement sample may be obtained from the surface of the developing roller 3, with dimensions of 1 cm×1 cm and having a thickness of 3 mm. Positive ions were discharged onto the sample using a MILTY Zerostat3, and the potential of the first dielectric portions 31 was measured for a predetermined amount of time in KFM mode of a scanning probe microscope (SPA300 manufactured by Hitachi High-Tech Science Corporation). The CR was then calculated from the potential attenuation rate.

To form the surface layer 30*c* such as illustrated in FIGS. 2A through 2C, polyethylene resin particles having an average particle diameter of 30 μm is dispersed in urethane resin serving as a binder, for example. Accordingly, the polyethylene resin particles serve as the first dielectric portions 31 and the urethane resin serves as the second dielectric portion 32. The amount of inclusion of polyethylene resin particles in the present embodiment is 70 parts by mass as to 100 parts by mass of the urethane region, so that the area of the first dielectric portions 31 is around 50% of the entire area.

The developing system in the first embodiment takes advantage of the relationship regarding the work functions of the first dielectric portions 31 and second dielectric portion 32 on the surface of the developing roller 3, and the charging layer 41 of the developing blade 4. The work function of the material used in forming the surface of first dielectric portions 31 of the developing roller 3 was 5.57 eV when measured at irradiating light amount of 250 nW using a surface analysis device (Model AC-2, manufactured by RIKEN KEIKI Co., Ltd.). The work function of the material used in forming the second dielectric portion 32, when measured in the same way, was 5.86 eV.

The developing blade 4 according to the first embodiment was provided with the charging layer 41 by laminating a phosphor bronze thin plate with a polyamide resin. In the first embodiment, the thickness of the phosphor bronze thin plate was formed to a thickness of 0.1 mm and the thickness of the polyamide resin was 0.1 mm. The work function of the charging layer 41 was measured at 5.42 eV according to the above-described measurement method.

Figure 3:
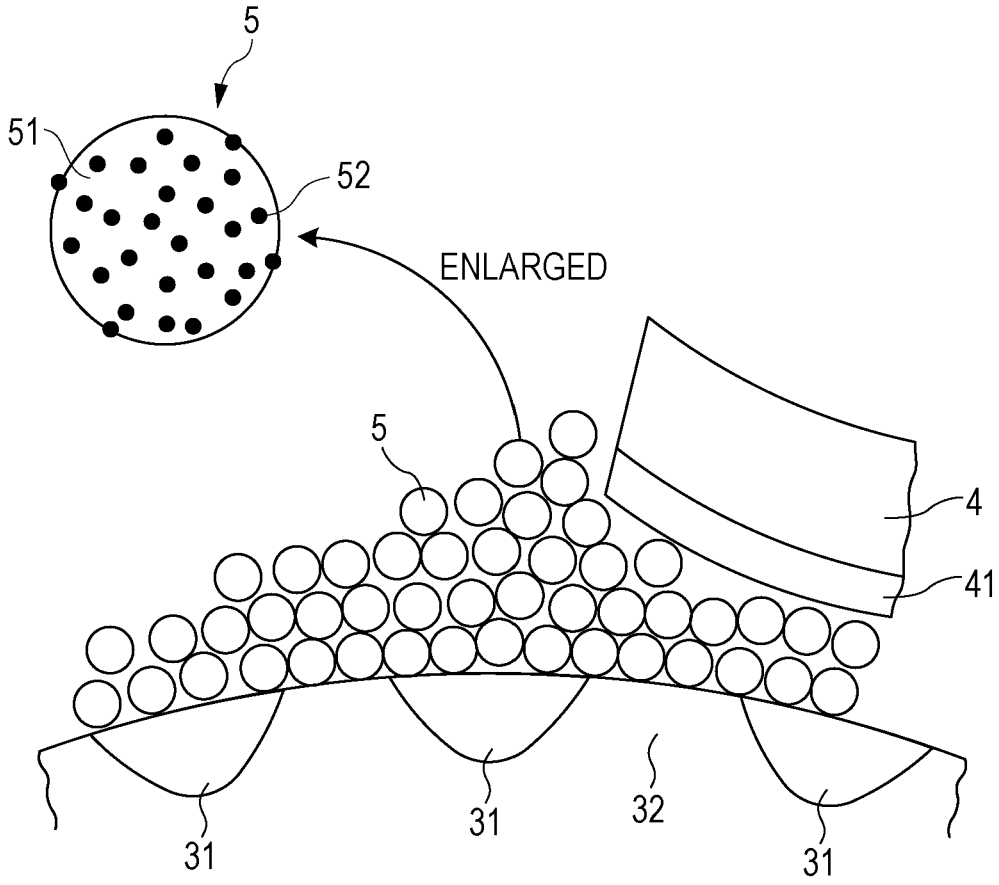
FIG. 3 is a schematic diagram illustrating toner nearby a regulating portion.

FIG. 3 illustrates toner nearby the regulating portion. The toner 5 in the first embodiment used in the first embodiment was formed by dispersing additive particles 52 on the surface of generally grain-shaped negatively-chargeable colored particles 51, formed of non-magnetic styrene acrylic-polyester resin colored by a pigment. An aluminum complex of dialkyl salicylic acid was used for the additive particles 52. The toner was prepared by adding 0.5 parts by mass of the additive particles 52 to 100 parts of the colored particles 51, and stirring at a high speed to process the toner surface. The work functions of the colored particles 51 and additive particles 52 work found to be 5.96 eV and 5.74 eV respectively, according to the above-described measurement method.

A DC developing bias of −300 V was applied to the developing roller 3 in the first embodiment, by a developing bias applying unit 61 illustrated in FIG. 1. A latent image design was included in the photosensitive drum 1 using the charging roller 7 and exposure device 91, so as to be −500 V at solid white image portions and −100 V at solid image portions. In the first embodiment, a toner coating amount of 0.54 mg/cm$^2$ is needed on the photosensitive drum 1 at the time of forming a solid image, in order to obtain good image density. Accordingly, a toner coating amount of 0.45 mg/cm$^2$ is needed on the developing roller 3 to this end.

The materials of the first dielectric portions 31 and second dielectric portion 32 of the developing roller 3, the charging layer 41 of the developing blade 4, the colored particles 51, and the additive particles 52, have been selected in the first embodiment, so that the work functions are as mentioned above. Thus, (−) colored particles 51<second dielectric portion 32<additive particles 52<first dielectric portion 31<charging layer 41 (+)

in triboelectric series.

Moreover, the difference in work functions between the colored particles 51 and second dielectric portion 32 is arranged to be smaller than the difference in work functions between the second dielectric portion 32 and additive particles 52. Thus, friction between the toner 5 and the second dielectric portion 32 causes the colored particles 51 to be charged negatively and the additive particles 52 to be charged positively, and accordingly the second dielectric portion 32 is charged negatively due to friction with the additive particles 52 which has the greater work function. The first dielectric portion 31 and charging layer 41 are charged positively due to function with the toner 5. Thus, there is generated between the surface of the developing roller 3 and the surface of the charging layer 41 a potential difference causing the toner 5 to move to the charging layer 41.

Figure 4A:
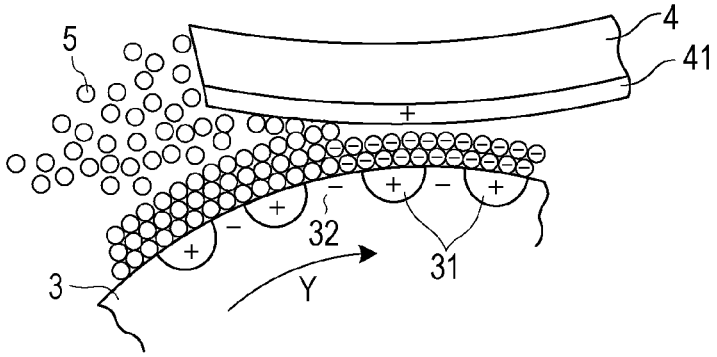
FIGS. 4A through 4C are schematic cross-sectional diagrams illustrating a charged state when forming a solid image according to the first embodiment.
Figure 4B:
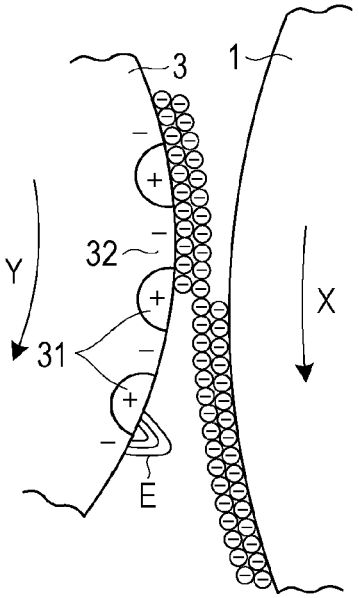
Figure 4C:
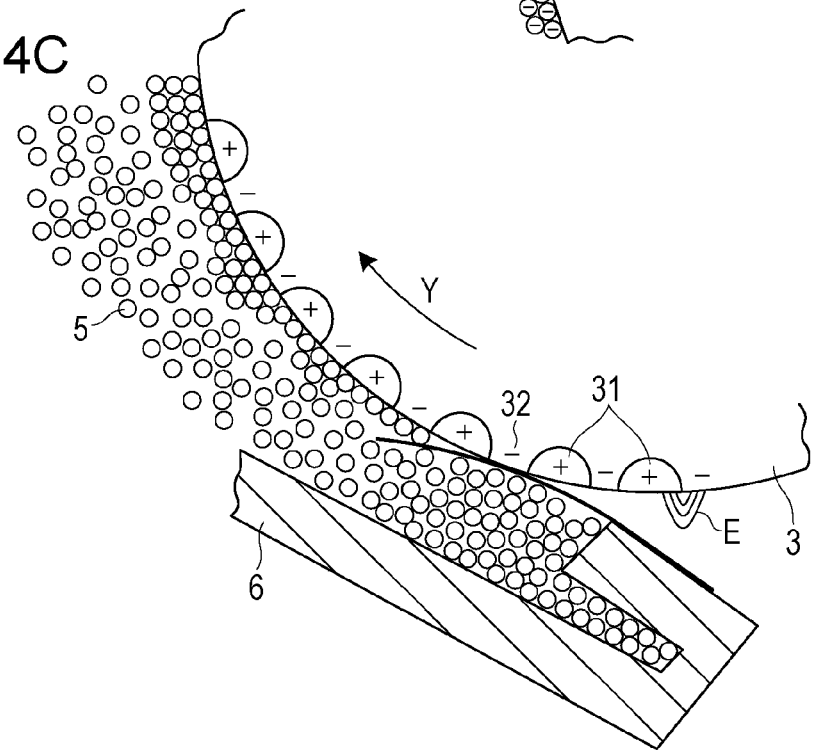
Figure 5A:
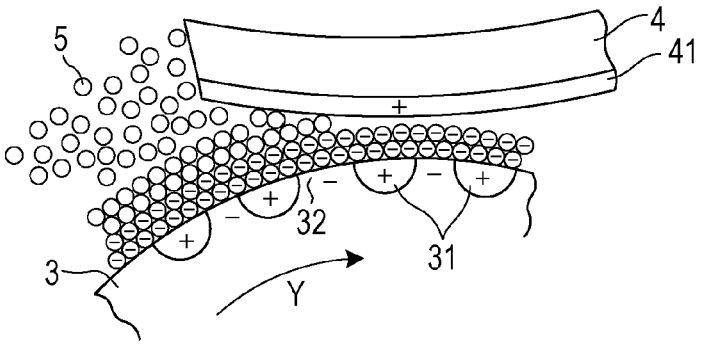
FIGS. 5A through 5C are schematic cross-sectional diagrams illustrating a charged state when forming a solid white image according to the first embodiment.
Figure 5B:
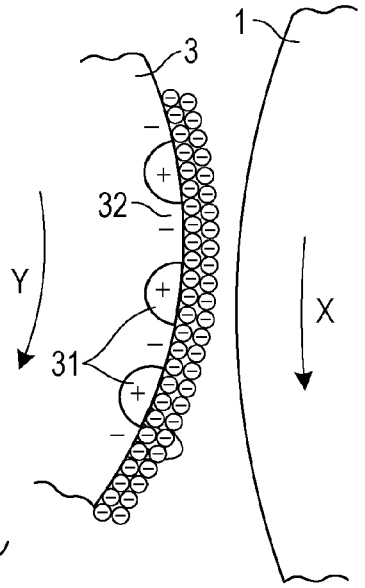
Figure 5C:
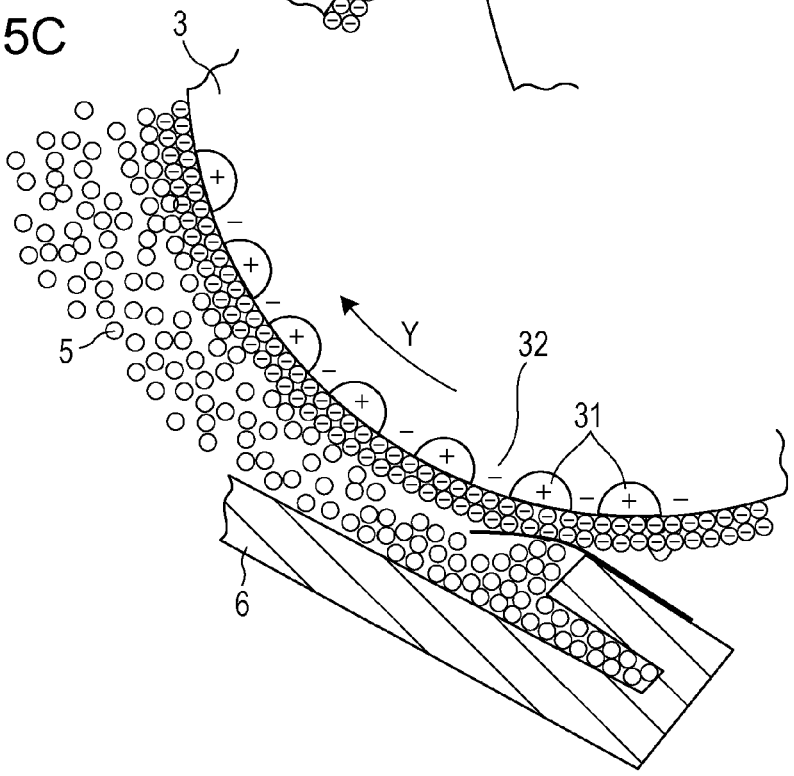

The developing system according to the first embodiment will be described with reference to FIGS. 4A through 5C. FIGS. 4A through 4C are schematic cross-sectional views illustrating the charged state of the first dielectric portions 31, second dielectric portion 32, and toner 5 when forming a solid image according to the first embodiment. FIG. 4A is a diagram illustrating nearby the regulating portion, FIG. 4B is a diagram illustrating nearby the developing portion, and FIG. 4C is a diagram illustrating inside the developer container 6, downstream from the developing portion but upstream from the regulating portion, in the rotational direction of the developing roller 3. FIGS. 5A through 5C are schematic cross-sectional views illustrating the charged state of the first dielectric portions 31, second dielectric portion 32, and toner 5 when forming a solid white image according to the first embodiment. FIG. 5A is a diagram illustrating nearby the regulating portion, FIG. 5B is a diagram illustrating nearby the developing portion, and FIG. 5C is a diagram illustrating inside the developer container 6, downstream from the developing portion but upstream from the regulating portion, in the rotational direction of the developing roller 3.

The first embodiment uses all of the toner coated on the developing roller 3 when forming a solid image. The circles in FIGS. 4A through 5C represent toner particles. Those with nothing inscribed therein represent uncharged or low-charged toner particles, and those with a "–" (minus) sign represent toner particles which have been regulated by the surface of the developing roller 3 and the charging layer 41 of the developing blade 4 and charged.

First, suppression of solid image defective reproduction which occurs when forming solid images will be described with reference to FIGS. 4A through 4C. Friction between the other 5 and the developing blade 4 and developing roller 3 at the regulating portion imparts the toner 5 and second dielectric portion 32 with charge of a negative polarity, and imparts the charging layer 41 and first dielectric portion 31 with charge of a positive polarity, as illustrated in FIG. 4A. Accordingly, microfields are formed between the first dielectric portions 31 and the second dielectric portion 32.

As illustrated in FIG. 4B, all toner on the developing roller 3 is developed. Accordingly, there is no toner 5 on the developing roller 3 when the developing process ends. As illustrated in FIG. 4C, around three toner layers are formed on the developing roller 3 within the developer container 6 by the gradient force of the microfields. Accordingly, toner coating amount of around three layers of toner can be obtained on the developing roller 3 even after printing a solid image as illustrated in FIG. 4A, so solid image defective reproduction can be suppressed.

Next, suppression of solid image defective reproduction which occurs when forming solid white images will be described with reference to FIGS. 5A through 5C. Microfields are formed between the first dielectric portions 31 and the second dielectric portion 32 at the regulating portion, in the same way as when forming solid images. As illustrated in FIG. 5B, the toner 5 on the developing roller 3 remains on the developing roller 3 at the developing portion instead of being transferred to the photosensitive drum 1. As illustrated in FIG. 5C, around four toner layers are formed on the developing roller 3 within the developer container 6 by the gradient force of the microfields. Accordingly, toner coating amount of around four layers of toner can be obtained on the developing roller 3 even after printing a solid white image as illustrated in FIG. 5A, so solid image defective reproduction can be suppressed.

As described with reference to FIGS. 4A through 5C, the coated amount of toner after passing through the regulating portion when forming solid images and the coated amount of toner after passing through the regulating portion when forming solid white images can be made to be equal in the first embodiment. Accordingly, solid image defective reproduction can be suppressed.

Next, a mechanism for suppressing ghost images according to the first embodiment will be described with reference to FIGS. 6A through 8B. Ghosting is a phenomenon where, when a solid image with high density is formed and then a halftone image or solid white image is formed, traces of the solid image appear on the halftone image or solid white image, for example.

The circles in FIGS. 6A through 7F represent toner particles. Those with nothing inscribed therein represent uncharged or low-charged toner particles, and those with a "–" (minus) sign represent toner particles which have been regulated by the surface of the developing roller 3 and the charging layer 41 of the developing blade 4 and charged, and toner particles which have rolled over the surface of the developing roller 3 and have become charged.

Figure 6A:
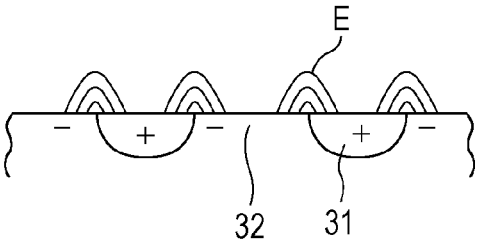
FIGS. 6A through 6F are explanatory diagrams describing a mechanism of adhesion of toner to the developing roller according to the first embodiment.
Figure 6D:
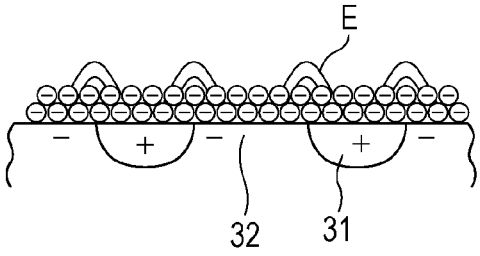
Figure 6B:
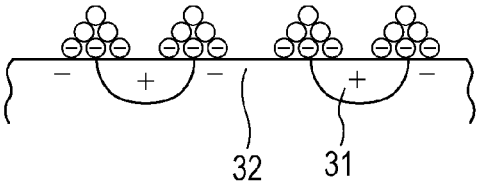
Figure 6E:
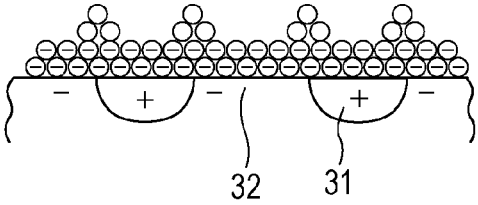
Figure 6C:
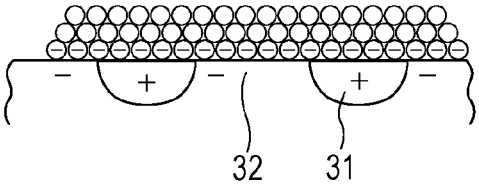
Figure 6F:
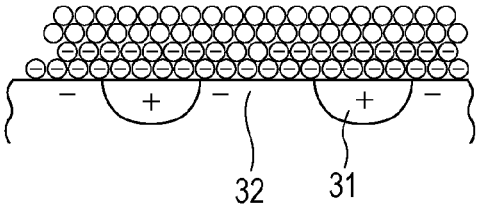

First, the mechanism by which the toner is adhered to the surface of the developing roller 3 will be described with reference to FIGS. 6A through 6F. FIGS. 6A through 6F are explanatory diagrams of the mechanism by which the toner is adhered to the developing roller 3 according to the first embodiment. FIGS. 6A through 6C are diagrams for describing the mechanism by which the toner is adhered to the developing roller 3 when forming a solid image, and FIGS. 6D through 6F are diagrams for describing the mechanism by which the toner is adhered to the developing roller 3 when forming a solid white image.

When forming a solid image, the surface of the developing roller 3 is in a state uncoated with toner as illustrated in FIG. 6A, and in this state enters the developer container 6. As illustrated in FIG. 6B, uncharged or low-charged toner is attracted by the gradient force at the surface of the first dielectric portions 31 generated by the microfields E, and the toner which comes into contact with the surface of the developing roller 3 is charged negatively. This adhered toner 5 forms small mounds on the surface of the developing roller 3 as illustrated in FIG. 6B, with other toner particles borne between these mounds, thus forming around three layers of toner as illustrated in FIG. 6C.

On the other hand, When forming a solid white image, negative charge of the toner coat is layered on the surface of the developing roller 3, so the surface potential of the toner layer on the first dielectric portions 31 and second dielectric portion 32 shifts to negative potential, and forms microfields E as illustrated in FIG. 6D. The uncharged or low-charged toner is attracted by the gradient force at the surface of the second dielectric portion 32 generated by the microfields E, as illustrated in FIG. 6E. This adhered toner 5 forms small mounds on the surface of the developing roller 3, with other toner particles borne between these mounds, thus forming around four layers of toner as illustrated in FIG. 6F.

Figure 7A:
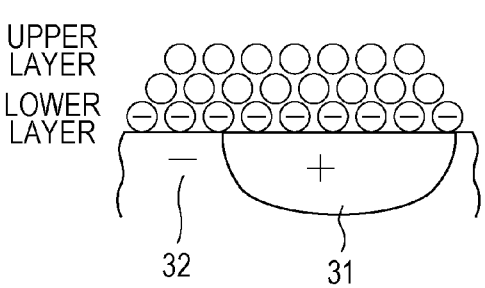
FIGS. 7A through 7F are explanatory diagrams describing a mechanism of regulating toner layer thickness by a regulating member according to the first embodiment.
Figure 7D:
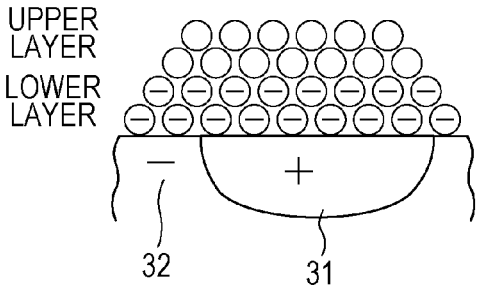
Figure 7B:
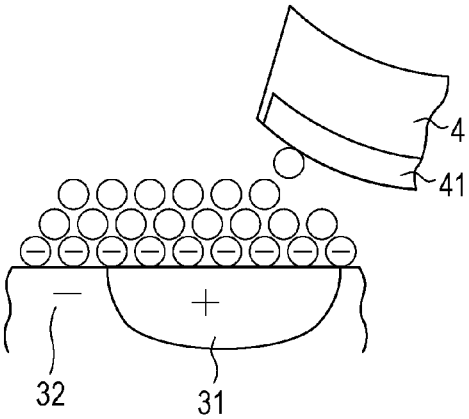
Figure 7E:
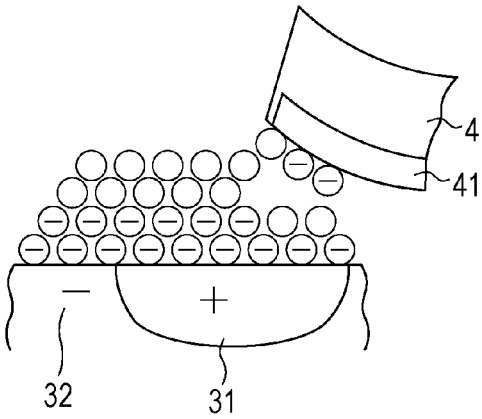
Figure 7C:
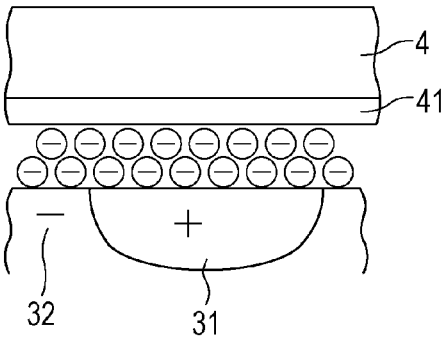
Figure 7F:
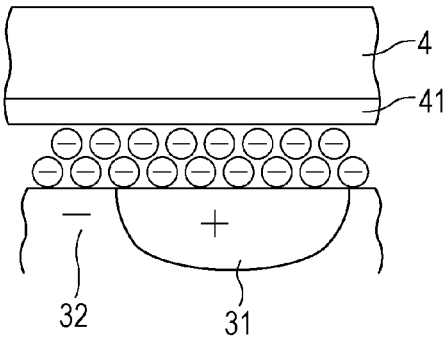
Figure 8A:
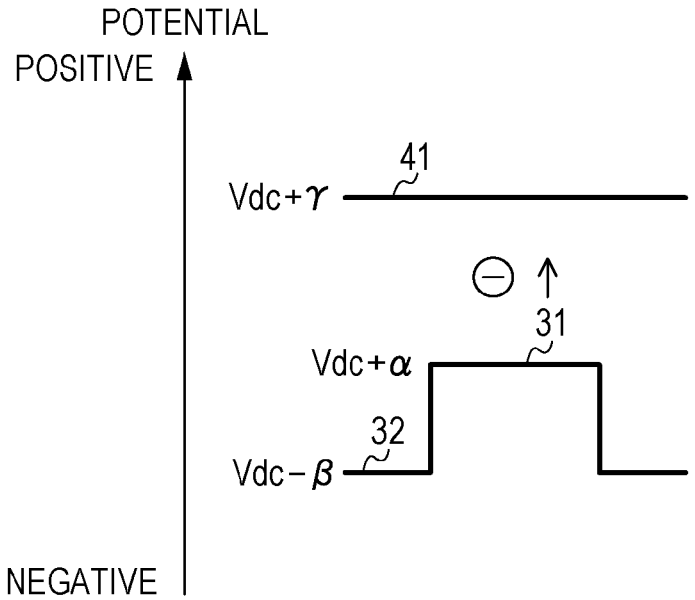
FIGS. 8A and 8B are frame formats illustrating the relationship of potential among a first dielectric portion, a second dielectric portion, and a charging layer, according to the first embodiment.
Figure 8B:
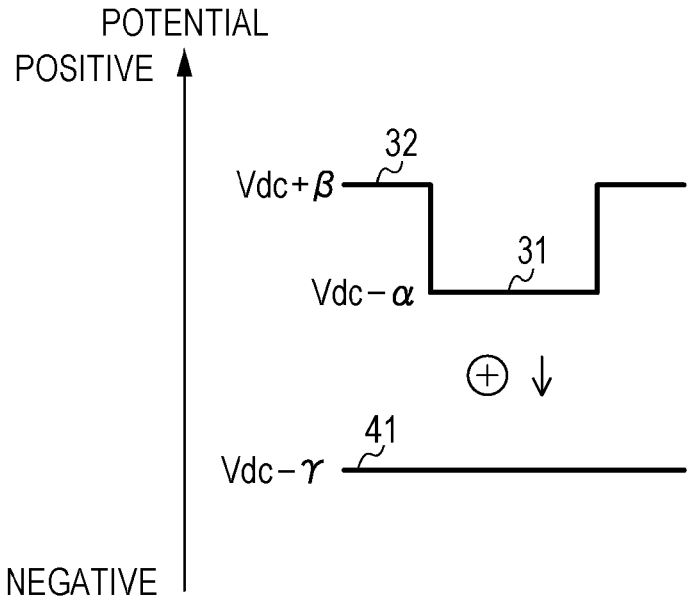

Next, the mechanism of toner layer regulation by the developing blade 4 will be described with reference to FIGS. 7A through 8B. FIGS. 7A through 7F are explanatory diagrams of the mechanism by which the toner layer thickness is regulated at the regulating portion according to the first embodiment. FIGS. 7A through 7C are diagrams for describing the mechanism by which the toner layer thickness is regulated when forming a solid image, and FIGS. 7D through 7F are diagrams for describing the mechanism by which the toner layer thickness is regulated when forming a solid white image. FIGS. 8A and 8B are frame formats illustrating the relationship in potential among the first dielectric portions 31, second dielectric portion 32, and charging layer 41 according to the first embodiment. FIG. 8A illustrates a case where the toner is charged negatively, and FIG. 8B illustrates a case where the toner is charged positively.

When forming a solid image, a toner layer of around three layers is formed on the surface of the developing roller 3 as illustrated in FIG. 7A, and toner of the upper layer where regulation by the gradient force is weak is mechanically scraped off of the surface of the developing roller 3, as illustrated in FIG. 7B. The toner on the lower layer is conveyed to the regulating portion and negatively charged, as illustrated in FIG. 7C.

On the other hand, when forming a solid white image, a toner layer of around four layers is formed on the surface of the developing roller 3 as illustrated in FIG. 7D, and is regulated as illustrated in FIGS. 7E and 7F.

In the first embodiment, (−) colored particles 51<second dielectric portion 32<additive particles 52<first dielectric portion 31<charging layer 41 (+)

in triboelectric series.

Accordingly, the potential relationship of the first dielectric portions 31, second dielectric portion 32, and charging layer 41, is such that the first dielectric portion 31 is at the developing bias (hereinafter "Vdc")+α, the second dielectric portion 32 is at Vdc−β, and the charging layer 41 is at Vdc+γ, as illustrated in FIG. 8A. Thus, the negatively-charged toner on the surface of the developing roller 3 is more readily scraped off from the surface of the developing roller 3 due to the electric field between the charging layer 41 and the first dielectric portions 31 as illustrated in FIG. 7E. More toner is scraped off at this time, since there is more negatively-charged toner layered higher than when forming a solid image.

As described above, the first embodiment is configured such that the first dielectric portions 31 and second dielectric portion 32 coexist exposed in a scattered manner in increments of minute areas on the surface of the developing roller 3, and such that (−) colored particles 51<second dielectric portion 32<additive particles 52<first dielectric portion 31<charging layer 41 (+)

in triboelectric series. Further, the difference in work functions between the colored particles 51 and second dielectric portion 32 is arranged to be smaller than that between the second dielectric portion 32 and additive particles 52. This enables ghosting and solid image defective reproduction to be markedly reduced in a developing device from which the developing agent feed member has been omitted. Note that in the present embodiment, the first dielectric portions 31 and second dielectric portion 32 can be charged to different polarities using only the toner, so no special members are needed to charge the first dielectric portions 31 and second dielectric portion 32, and ghosting and solid image defective reproduction can be reduced with a simple configuration.

While the materials of the developing roller 3, developing blade 4, and toner 5 have been described as above, the present embodiment is not restricted thusly. For example, if the toner is positively-charged toner, the materials may be such that (−) charging layer 41<first dielectric portions 31<additive particles 52<second dielectric portion 32<colored particles 51 (+)

in triboelectric series, with the potential relationship of the first dielectric portions 31, second dielectric portion 32, and charging layer 41 being such as illustrated in FIG. 8B.

In a case where the difference between the first dielectric portions 31 and charging layer 41 is great in triboelectric series, the toner scraping effect of the toner on the developing roller 3 by the electric field at the time of regulation is greater, and image density may be reduced. In such a case, a suitable image density can be maintained by increasing the rotational speed of the developing roller 3.

Also, a configuration may be made where (−) colored particles 51<second dielectric portion 32<first dielectric portions 31<additive particles 52<charging layer 41 (+)

in triboelectric series. In this case, the difference in work functions between the colored particles 51 and second dielectric portion 32 is made to be smaller than that between the second dielectric portion 32 and additive particles 52, and also the difference in work functions between the colored particles 51 and first dielectric portion 31 is made to be greater than that between the first dielectric portion 31 and additive particles 52. Thus, the first dielectric portions 31 can be charged positively and the second dielectric portion 32 negatively, yielding the same effect as with the present embodiment.

Also, a configuration may be made where (−) colored particles 51<second dielectric portion 32<first dielectric portions 31<charging layer 41<additive particles 52 (+)

in triboelectric series. In this case, the difference in work functions between the colored particles 51 and second dielectric portion 32 is made to be smaller than that between the second dielectric portion 32 and additive particles 52, and also the difference in work functions between the colored particles 51 and first dielectric portion 31 is made to be greater than that between the first dielectric portion 31 and additive particles 52. Thus, the first dielectric portions 31 can be charged positively the second dielectric portion 32 negatively, and the charging layer 41 positively, yielding the same effect as with the present embodiment.

Though surface coarseness of the developing roller 3 has not been discussed in the first embodiment, toner conveyance can be controlled by surface coarseness of the developing roller 3, which is effective in dealing with ghosting and solid image defective reproduction. Neither is conductivity of the charging layer 41 discussed, but making the charging layer 41 conductive can prevent charge-up on an elastic blade, thus preventing the toner from being imparted with unnecessary charge. Using such a conductive charging layer 41 does not affect the mechanism of suppressing ghosting described above, yielding the same effect as with the present embodiment.

Second Embodiment

Figure 9:
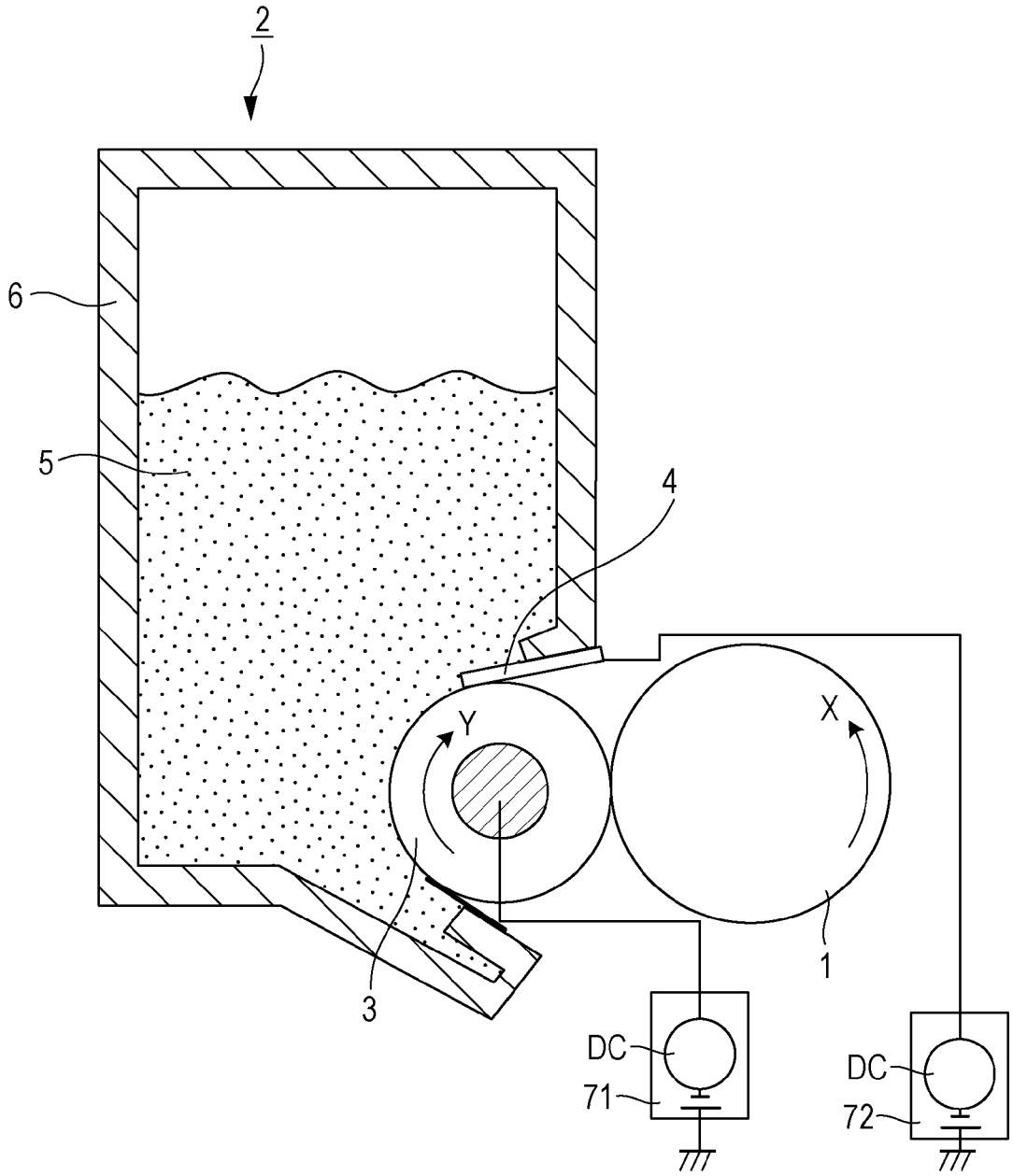
FIG. 9 is a schematic cross-sectional view of a developing device according to a second embodiment.
Figure 10A:
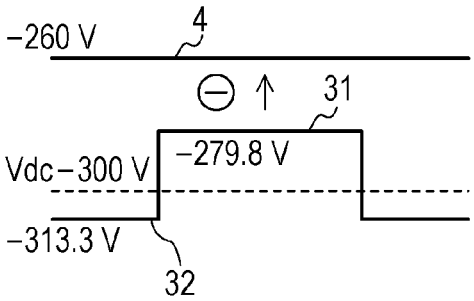
FIGS. 10A through 10D are frame formats illustrating the relationship of potential in a configuration according to the second embodiment and modifications thereof.
Figure 10B:
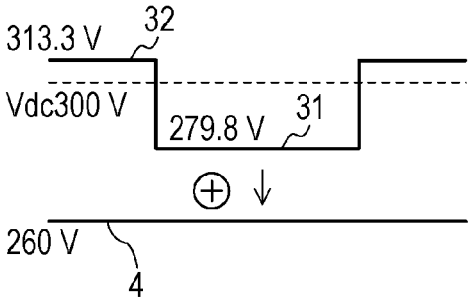
Figure 10C:
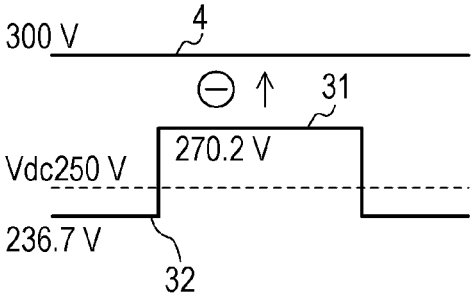
Figure 10D:
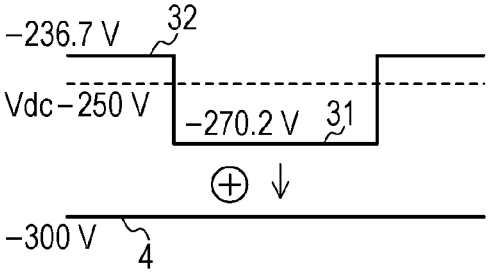

Next, a second embodiment will be described with reference to FIGS. 9 through 10D. FIG. 9 is a schematic cross-sectional diagram illustrating a developing device according to the second embodiment. FIGS. 10A through 10D are frame formats illustrating the potential relationship of the first dielectric portions 31, second dielectric portion 32, and developing blade 4, according to the second embodiment and modifications thereof. FIG. 10A illustrates a case according to the second embodiment where the developing bias is of negative polarity and the toner is charged to negative polarity. FIG. 10B illustrates a case according to a modification of the second embodiment where the developing bias is of positive polarity and the toner is charged to positive polarity. FIG. 10C illustrates a case according to a modification of the second embodiment where the developing bias is of positive polarity and the toner is charged to negative polarity. FIG. 10D illustrates a case according to a modification of the second embodiment where the developing bias is of negative polarity and the toner is charged to positive polarity. In all of these cases, the potential relationship is set such that an electric field is generated whereby toner is scraped off of the first dielectric portions 31.

Unlike the developing device 2 described in the first embodiment illustrated in FIG. 1, no charging layer 41 is provided to the developing blade 4 in the developing device 2 according to the second embodiment. Instead, the image forming apparatus according to the second embodiment includes a bias applying unit 71 which applies voltage to the developing roller 3, and a bias applying unit 72 serving as a voltage applying unit to apply voltage to the developing blade 4. The bias applying unit 72 applies voltage to the developing blade 4 (blade bias), thereby controlling the amount of toner coated on the surface of the developing roller 3. Other configurations are the same as with the first embodiment, so configurations which are the same are denoted by the same reference numerals, and description thereof will be omitted.

In the second embodiment, the electric field for scraping off toner from the first dielectric portions 31 and the second dielectric portion 32 is formed by blade bias by the bias applying unit 72. Accordingly, the potential at each dielectric portion during image formation needs to be accurately known. Potential measurement of the dielectric portions in the second embodiment was performed as follows.

(1) A cutout measurement sample was obtained from the surface of the developing roller 3 following forming a solid white image, with dimensions of 1 cm×1 cm and having a thickness of 3 mm.

(2) 30 minutes after the image forming was completed, the potential of the first dielectric portions 31 and second dielectric portion 32 was measured in KFM mode of the scanning probe microscope (SPA300 manufactured by Hitachi High-Tech Science Corporation).

(3) The potential attenuation at 30 minutes is calculated from the relative permittivity and resistivity of the first dielectric portions 31 and second dielectric portion 32, from which the potential of the dielectric portions at the time of image formation is found.

The values measured in (1) were 20 V and −10 V for the first dielectric portion 31 and second dielectric portion 32, respectively. The polyethylene resin particles of the first dielectric portions 31 exhibited relative permittivity of 2.5 and resistivity of 1 E+16 Ω·m, and potential attenuation was 1%, so the charged potential during image formation is 20.2 V. The urethane resin particles of the second dielectric portion 32 exhibited relative permittivity of 5 and resistivity of 1 E+14 Ω·m, and potential attenuation was 33%, so the charged potential during image formation is −13.3 V. DC −300 V is applied to the developing roller 3 in the second embodiment, so the potential at the first dielectric portions 31 is −279.8 V, and the potential at the second dielectric portion 32 is −313.3 V.

Table 1 illustrates the results of applying blade bias by the bias applying unit 72 and forming images in the second embodiment. Toner of negative polarity is used in the second embodiment, so setting a blade-to-developing-roller bias to positive bias generates an electric field causing the toner 5 to move from the surface of the developing roller 3 to the developing blade 4. Note that this blade-to-developing-roller bias is a value obtained by subtracting the developing bias from the blade bias, i.e., the potential difference between the developing roller 3 and the developing blade 4.

TABLE 1

| Blade-to-developing-roller bias | Ghosting | Density |
|---|---|---|
| −100 V | P | G |
| 0 V | P | G |
| +20 V | F | G |
| +25 V | G | G |
| +50 V | G | G |
| +100 V | G | F |

Evaluation

Ghosting: G means Good with no occurrence, F means Fair with slight occurrence but within tolerance range, and P means Poor or unacceptable.

Density: G means Good with no reduction in density, and F means within tolerance range.

As can be seen from Table 1, changing the blade-to-developing-roller bias from a negative value to a positive value suppresses ghost images. The mechanism by which ghost images are suppressed is the same as in the first embodiment, with the upper layer of toner in FIGS. 7B and 7E being scraped off by the electric field generated by the blade-to-developing-roller bias. The charged potential of the first dielectric portions 31 in the second embodiment is 20.2 V, so ghost images can be markedly suppressed by a blade-to-developing-roller bias of +25 V to +50 V which exceeds that value. Increasing the value of the blade-to-developing-roller bias to the positive side increases the effects of the electric field scraping off the toner on the developing roller 3 when regulating, leading to reduced image density, but suitable image density can be maintained by increasing the rotational speed of the developing roller.

The image forming apparatus 100 illustrated in FIG. 11 including the developing device 2 according to the second embodiment illustrated in FIG. 9 was used to perform image forming on 1000 A4-sized sheets, with the potentials of the second dielectric portion 32, first dielectric portions 31, and developing blade 4 each as illustrated in FIG. 10A. As a result, good images were obtained with suitable image density maintained, and no occurrence of defective images.

Thus, according to the second embodiment, the surface of the developing roller 3 is configured such that first dielectric portions 31 and second dielectric portion 32 coexist exposed in a scattered manner in increments of minute areas, and such that (−) colored particles 51<second dielectric portion 32<additive particles 52<first dielectric portion 31 (+) in triboelectric series. Further, the difference in work functions between the colored particles 51 and second dielectric portion 32 is arranged to be smaller than that between the second dielectric portion 32 and additive particles 52. The potentials of the first dielectric portions 31, second dielectric portion 32, and developing blade 4 are set to the relationship in FIG. 10A. This enables an image forming apparatus to be provided, where ghosting and solid image defective reproduction are markedly reduced in a developing device from which the developing agent feed member has been omitted.

While a configuration where (−) colored particles 51<second dielectric portion 32<additive particles 52<first dielectric portion 31 (+) in triboelectric series is used in the second embodiment, this may be (−) colored particles 51<second dielectric portion 32<first dielectric portion 31<additive particles 52 (+) in triboelectric series instead. In this case, the difference in work functions between the colored particles 51 and second dielectric portion 32 is made to be smaller than that between the second dielectric portion 32 and additive particles 52, and the difference in work functions between the colored particles 51 and first dielectric portions 31 is made to be greater than that between the first dielectric portion 31 and additive particles 52. This allows the first dielectric portions 31 to be charged positively and the second dielectric portion 32 to be charged negatively, yielding the same effects as the present embodiment.

The advantages of the configurations illustrated in the above-described embodiments are as follows. According to the configurations of the embodiments, occurrence of defective images can be suppressed while reducing size and costs of the apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-173701, filed Aug. 23, 2013, which is hereby incorporated by reference herein in its entirety.

What is claimed is:

1. A developing device comprising:

a developing agent including colored particles and additive particles disposed on the surface of the colored particles;

a developing agent bearing member configured to bear on a surface thereof the developing agent, the surface of the developing agent bearing member including a first dielectric portion, and a second dielectric portion; and a regulating member configured to regulate the thickness of a layer of developing agent borne by the developing agent bearing member;

wherein, in triboelectric series, the first dielectric portion is between the regulating member and the additive particles, the additive particles are between the first dielectric portion and the second dielectric portion, and the second dielectric portion is between the additive particles and the colored particles;

and wherein the difference between the work function of the colored particles and the work function of the second dielectric portion is smaller than the difference between the work function of the second dielectric portion and the work function of the additive particles.

2. The developing device according to claim 1, wherein the work functions of the first dielectric portion and second dielectric portion are different.

3. The developing device according to claim 1, wherein the regulating member includes a charging layer configured to come into contact with the developing agent bearing member.

4. The developing device according to claim 1, wherein the developing device makes up part of a process cartridge, which is detachable from a main body of an image forming apparatus and also includes an image bearing member.

5. A developing device comprising:

a developing agent including colored particles and additive particles disposed on the surface of the colored particles;

a developing agent bearing member configured to bear on a surface thereof the developing agent, the surface of the developing agent bearing member including a first dielectric portion, and a second dielectric portion; and a regulating member configured to regulate the thickness of a layer of developing agent borne by the developing agent bearing member;

wherein, in triboelectric series, the additive particles are between the regulating member and the first dielectric portion, the first dielectric portion is between the additive particles and the second dielectric portion, and the second dielectric portion is between the first dielectric portion and the colored particles;

wherein the difference between the work function of the colored particles and the work function of the second dielectric portion is smaller than the difference between the work function of the second dielectric portion and the work function of the additive particles;

and wherein the difference between the work function of the colored particles and the work function of the first dielectric portion is greater than the difference between the work function of the first dielectric portion and the work function of the additive particles.

6. A developing device comprising:

a developing agent including colored particles and additive particles disposed on the surface of the colored particles;

a developing agent bearing member configured to bear on a surface thereof the developing agent, the surface of the developing agent bearing member including a first dielectric portion, and a second dielectric portion; and a regulating member configured to regulate the thickness of a layer of developing agent borne by the developing agent bearing member;

wherein, in triboelectric series, the regulating member is between the additive particles and the first dielectric portion, the first dielectric portion is between the regulating member and the second dielectric portion, and the second dielectric portion is between the first dielectric portion and the colored particles;

wherein the difference between the work function of the colored particles and the work function of the second dielectric portion is smaller than the difference between the work function of the second dielectric portion and the work function of the additive particles;

wherein the difference between the work function of the colored particles and the work function of the first dielectric portion is greater than the difference between the work function of the first dielectric portion and the work function of the additive particles;

and wherein the difference between the work function of the colored particles and the work function of the regulating member is greater than the difference between the work function of the regulating member and the work function of the additive particles.

7. An image forming apparatus comprising:

a developing agent including colored particles and additive particles disposed on the surface of the colored particles;

a developing agent bearing member configured to bear on a surface thereof the developing agent, the surface of the developing agent bearing member including a first dielectric portion, and a second dielectric portion;

a regulating member configured to regulate the thickness of a layer of developing agent borne by the developing agent bearing member; and a voltage applying unit configured to apply voltage to the regulating member;

wherein, in triboelectric series, the additive particles are between the first dielectric portion and the second dielectric portion, and the second dielectric portion is between the additive particles and the colored particles, wherein the difference between the work function of the colored particles and the work function of the second dielectric portion is smaller than the difference between the work function of the second dielectric portion and the work function of the additive particles;

and wherein the voltage applying unit applies voltage to the regulating member such that an electric field is formed which causes the developing agent to move from the first dielectric portion to the regulating member.

8. An image forming apparatus comprising:

a developing agent including colored particles and additive particles disposed on the surface of the colored particles;

a developing agent bearing member configured to bear on a surface thereof the developing agent, the surface of the developing agent bearing member including a first dielectric portion, and a second dielectric portion;

a regulating member configured to regulate the thickness of a layer of developing agent borne by the developing agent bearing member; and a voltage applying unit configured to apply voltage to the regulating member;

wherein, in triboelectric series, the first dielectric portion is between the additive particles and the second dielectric portion, and the second dielectric portion is between the first dielectric portion and the colored particles, wherein the difference between the work function of the colored particles and the work function of the second dielectric portion is smaller than the difference between the work function of the second dielectric portion and the work function of the additive particles;

wherein the difference between the work function of the colored particles and the work function of the first dielectric portion is greater than the difference between the work function of the first dielectric portion and the work function of the additive particles;

and wherein the voltage applying unit applies voltage to the regulating member such that an electric field is formed which causes the developing agent to move from the first dielectric portion to the regulating member.

* * * * *